US011031712B2

(12) United States Patent
Annequin et al.

(10) Patent No.: US 11,031,712 B2
(45) Date of Patent: Jun. 8, 2021

(54) CONNECTOR FOR A PRINTED CIRCUIT BOARD EQUIPPED WITH AN ELECTRICAL SIGNAL TRANSMISSION LINE CONDUCTING ENCLOSURE

(71) Applicant: RAYDIALL, Voiron (FR)

(72) Inventors: Sébastien Annequin, Saint Nicolas de Macherin (FR); Denis Gabet, Colombe (FR); Quentin Noir, Voiron (FR)

(73) Assignee: RAYDIALL, Voiron (FR)

( * ) Notice: Subject to any disclaimer, the term of this patent is extended or adjusted under 35 U.S.C. 154(b) by 0 days.

(21) Appl. No.: 16/773,431

(22) Filed: Jan. 27, 2020

(65) Prior Publication Data

US 2020/0243992 A1 Jul. 30, 2020

(30) Foreign Application Priority Data

Jan. 28, 2019 (FR) ..... 1900751

(51) Int. Cl.
*H01R 12/72* (2011.01)
*H01R 12/58* (2011.01)

(52) U.S. Cl.
CPC ..... *H01R 12/724* (2013.01); *H01R 12/58* (2013.01)

(58) Field of Classification Search
CPC .. H01R 12/6594; H01R 12/724; H01R 12/58; H01R 24/50; H01R 13/426; H01R 13/4361; H01R 13/648; H01R 13/6594
See application file for complete search history.

(56) References Cited

U.S. PATENT DOCUMENTS 5,755,592 A * 5/1998 Hillbish ..... H01R 12/7029 439/541.5
9,004,944 B2 4/2015 Raydiall
2012/0156921 A1 6/2012 Annequin et al.
2016/0315427 A1* 10/2016 Kawakami ..... H01R 13/6594
2016/0315428 A1 10/2016 Kawakami et al.
2018/0366843 A1 12/2018 Maki
2019/0006795 A1 1/2019 Kondo et al.

FOREIGN PATENT DOCUMENTS

FR 2 969 400 A1 6/2012

OTHER PUBLICATIONS

French Search Report dated Oct. 9, 2019 for corresponding French Application No. 1900751.

* cited by examiner

*Primary Examiner* — Oscar C Jimenez
(74) *Attorney, Agent, or Firm* — Pearne & Gordon LLP

(57) ABSTRACT

The application relates to a connector (1), designed for a connection to a printed circuit board, the connector (1) extending along a longitudinal axis (X) and including an electrically-conducting body (2); at least one contact (8) accommodated, at least in part, within the body (2) with interposition of an electrical insulator (7) between them; a housing (3) defining an accommodation (6) configured for receiving all or part of the body; and an electrically-conducting cover (10) composed of at least one piece, inserted into the electrically-conducting body (2), such that at least one of the main faces (100) covers the front of the electrical insulator (7), in the rear part for accommodating the latter inside of the electrically-conducting body which is lacking a wall.

18 Claims, 13 Drawing Sheets

CONNECTOR FOR A PRINTED CIRCUIT BOARD EQUIPPED WITH AN ELECTRICAL SIGNAL TRANSMISSION LINE CONDUCTING ENCLOSURE

TECHNICAL FIELD

The subject of the present invention is a connector, notably L-shaped, for a printed circuit board.

The invention is applicable, for example, to a coaxial connector constructed according to the FAKRA standardized design (Automobile industry standards commission).

In the sense of the invention, the expression "coaxial connector according to the FAKRA standardized design" denotes a coaxial connector comprising a body whose mechanical dimensions in an axial cross-section of said body cooperate with the body of a complementary connector in order to establish a mechanical link between the two bodies are defined in the standard DIN 72594-1. Such connectors are generally used in the automobile field for data transmission cables.

The invention is also applicable to connectors for high-rate transmission circuits (LVDS).

The invention is generally applicable to any connection system device for transmission of RF signals and of data on a printed circuit.

PRIOR ART

FIGS. 1 to 6 show a connector 10, already commercially available, used for mounting onto a printed circuit board. The connector obtained may be of the SMT (Surface Mount Technology) type, of the "pin in paste" (in other words using the reflow solder paste to fix components) type or else of the "wave soldering" type, according for example to the U.S. Pat. No. 9,004,944B2 in the name of the applicant.

This connector 10 is L-shaped and comprises a body 2 and a housing 3 comprising an accommodation 6 in which the body is accommodated.

The body 2 is made of metal, notably of brass or of bronze, advantageously according to the technology known as 'cut-and-roll', essentially for reasons of cost.

The body 2 receives an insulator 7 inside of which several central contacts 8 are disposed. The central contacts 8 here are L-shaped, in other words they extend along a longitudinal axis comprising two portions 60 and 61 making an angle between them which, in the example described, is equal to 90°.

In this example, the housing 3 extends along a rectilinear longitudinal axis X. The housing 3 is for example made of plastic, notably of fibre-glass loaded polyamide.

The housing 3 comprises a front portion 11 having profiles allowing the connection to a housing of a complementary connector, a tubular central portion 12 whose internal diameter allows the body 2 to be received, and an end rear portion 13 around which an armour 14 is disposed.

By virtue of the presence of this armour 14, the mechanical forces generated with the printed circuit board are taken up by the housing 3 and the armour 14. Thus, the traction forces on the housing are transmitted to the armour and not to the body of the connector.

As shown in FIGS. 2 and 3, the rear portion 13 of the housing 3 may have a U-shaped transverse cross-section. This rear portion 13 of the housing receives a part 5 of the body which also has a U-shaped transverse cross-section, this part 5 comprising return sections 9 bent back against a free edge of the rear portion 13 of the housing, in order to hold the body 2 in position in the accommodation 6.

The armour 14 is made of metal, notably of brass or bronze notably made of a single piece, in particular by virtue of the technology of the 'cut-and-roll'. Accordingly, it is possible to reduce the costs of fabrication of the components despite the limited thickness obtained because the force take up is applied over the entirety of the armour.

The armour 14 has a U-shaped cross-section perpendicular to the axis X of the housing 3.

This armour 14 comprises a back 16 and two wings 17 connected by the back 16.

The armour 14 also comprises legs 18 allowing the fixing of the connector 1 to a printed circuit board.

The armour 14 furthermore comprises a portion 25 extending substantially perpendicularly to the longitudinal axis X of the housing 3 and closing off the longitudinal end 26 of the housing 3 at its rear portion 13.

The wings 17 and the back 16 of the armour 14 may be received in the thickness of the rear portion 13 of the housing 3, in other words in insets formed in the wings 17 and the back 16 of the armour 14. The armour 14 may be sandwiched between walls or ends 26 of the housing 3, as shown in FIG. 3.

In this type of connector, for reasons of electromagnetic armour and of integrity of the signal, it is necessary for the insulator 7 to be enclosed by a metal surface over the maximum length of the electrical transmission line.

Indeed, if the metal envelope has holes or slots, there is a risk of leakage of electrical signal, i.e. leakages of HF signals, which deteriorate the quality of the electrical signal.

As illustrated in FIG. 3, the body 2 surrounds the insulator 7 over a large part of the transmission line: the double-arrows somehow illustrate the confinement of the electrical signal formed.

However, the formation of the body 2 using a 'cut-and-roll' technique implies that it cannot completely surround the insulator since, owing to the shapes to be bent, it is necessary to create slots 200 in order to have a tool thickness for cutting out the part.

Moreover, certain shapes are not possible, because the material that it would be desirable to add would create an overlap of surfaces which would render the part impossible to make.

Thus, as shown in FIGS. 4 and 5A, the body 2 is open on its rear part.

One solution which comes naturally may comprise forming a rear part of the body which is hinged or the addition of a metal cover so as to enclose the electrical transmission line at the rear. In addition, the rear region could be filled by an additional insulator between the hinged part of the body and the elbow of the central contacts.

This solution would impose different dimensions between the transmission line parallel to the circuit and the transmission line perpendicular to the circuit at the rear of the connector, notably between the body and the central contacts, and a potential additional insulator to be added.

The consequence of this would be detrimental by introducing a mismatch of ultra-high-frequency impedance and greatly compromising the quality of the signal.

On the other hand, the rear region also remains open. Indeed, on the one hand, the slot 200 of the conducting body 2 which is provided in order to allow the cutting tool to pass is, by definition, lacking material. On the other hand, the openings S1, S3, which are the insulator surfaces perpendicular to the longitudinal axis X, are all the larger in the L-shaped versions of connectors, the front end of whose housing is positioned on top of the printed circuit, in other words the rear part perpendicular to the circuit is all the longer (FIGS. 5A, 5B).

There accordingly exists a need to improve the connectors, in particular L-shaped, designed for a connection to a printed circuit board, comprising a metal body formed according to a 'cut-and-roll' technique, notably in order to completely enclose the electrical insulator accommodating one or more central contacts and a need to thus improve the electromagnetic shielding and to eliminate, or at the very least, reduce as far as possible any impedance mismatch between the front and the rear of the connector.

The aim of the invention is to solve, at least partially, these needs.

DESCRIPTION OF THE INVENTION

For this purpose, one subject of the invention is a connector, designed for a connection to a printed circuit board, the connector extending in a longitudinal axis (X) and comprising:

an electrically-conducting body, at least one contact accommodated, at least in part, within the body with interposition of an electrical insulator between them, a housing defining an accommodation configured for receiving all or part of the body, the housing comprising a cavity, an electrically-conducting cover composed of at least one piece, inserted into the electrically-conducting body, such that at least one of its main faces covers the front of the electrical insulator, in the rear part of the accommodation of the latter inside of the electrically-conducting body which is lacking a wall, the electrically-conducting cover comprising portions which protrude above the body and arranged into the cavity of the housing so as to form two blocking points, in the two sense of the longitudinal direction (X), of the electrically-conducting cover in the housing.

The accommodation of the housing comprises a front part by which the connection to a complimentary connector is intended to be achieved, and a rear part opposite to the front part.

Preferably, the conducting body is formed with at least one slot at the front of the electrical insulator, said main face of the cover covering said slot.

According to one advantageous embodiment, another of the main faces of the cover covers the rear of the electrical insulator.

Preferably, according to this embodiment, the conducting body is realised with at least one slot, at the rear of the electrical insulator, the other main face of the cover covering said slot.

Thus, the invention comprises a conducting cover which is assembled as an additional component in a connector in order to form with the conducting body, preferably produced by a by 'cut-and-roll' technique, a complete metal envelope over the whole transmission line for electrical signals transmitted by the connector.

The conducting cover is sized with portions which, once the cover is mounted, are protruding in at least one cavity of the housing and act as blocking points of the housing in the two senses of the longitudinal direction (X).

By virtue of the cover according to the invention, the openings of the body, preferably together with its slots, are enclosed, which avoids leakages of HF signals and the cross-section of insulator through which the signals pass in the metal envelope may be as constant as possible over the whole length of the connector, which avoids the risk of ultra-high-frequency impedance mismatch.

As a consequence, a connector which can transmit RF signals reliably is obtained in a simple manner and at a lower cost, with a cover preferably composed of a single piece.

According to one advantageous variant embodiment, the cover is composed of a single piece of generally rectangular shape, whose two parallel main faces are connected via two lateral faces. Preferably, the single piece is shaped so that each lateral face join the protruding portions to form a U shape. Such a U shape improves the mechanical retention of the housing.

Advantageously, the U shapes of the electrically-conducting cover are arranged to be positioned outside the lateral parts of the electrically-conducting body. This allows to achieve an assembly of multiway connections with a unique electrically-conducting cover which is common to the connectors, such as described below.

According to one advantageous embodiment, the connector is L-shaped with the contact(s) which extend(s) along the longitudinal axis (X) and which comprise(s) at least one inclined portion, being notably perpendicular, with respect to a plane defined by a printed circuit board onto which the connector is designed to be connected.

According to this embodiment, the electrical insulator forming a L-shape, the main faces of the cover are advantageously perpendicular both to the plane and to the direction of connection with a complementary connector along the axis X, while covering the electrical insulator on either side of its elbow.

Advantageously, in order to best guarantee the electrical ground continuity, the cover is inserted into the body with physical contact between them.

Preferably, one and/or the other of the main faces of the cover has an exterior shape designed to fit that of the body. More preferably, one and/or the other of the main faces of the cover are in contact with interference fit respectively against the front face and rear face of the electrical insulator, in order to guarantee the mechanical positioning of the insulator and in order to improve the ultra-high-frequency matching.

According to one advantageous variant embodiment, the cover, preferably one and/or the other of its main faces, comprises at least one profile designed to capture the insulator, so as to block the latter.

According to one advantageous variant embodiment, the cover, preferably one and/or the other of its lateral faces connecting the main faces, comprises at least one retention profile cooperating with a complementary retention profile formed in the housing, so as to retain the cover in the housing. This retention may be achieved by capture or clip-on and thus guarantee an excellent mechanical retention of the cover in the housing.

According to one advantageous variant embodiment, the rear main face of the cover comprises at least one support tab cooperating with a notch formed in the body, so as to prevent the flexing of said rear face when the insulator and/or the contacts are pushed towards the rear of the connector.

Advantageously, the cover, preferably one and/or the other of its main faces, comprises at least one leg designed to allow the fixing of the connector onto a printed circuit board, preferably by insertion and/or soldering.

The portions protruding above the body into the cavity of the housing form a mechanical end-stop when a traction force is exerted on the housing.

Another subject of the invention is an assembly of multiway connections, comprising at least two connectors such as previously described, each comprising an electrically-conducting body according to any one of the preceding claims arranged side-by-side, in a housing, and a cover formed as at least one piece, inserted into the electrically-conducting bodies, such that at least two of its main faces cover, at least partially, the electrical insulators, in the parts of their accommodations inside of the electrically-conducting bodies which are lacking a wall.

According to one advantageous variant, the cover is composed of a single piece of generally rectangular shape whose two parallel main faces are connected via two lateral faces. Preferably, the single piece is shaped so that each lateral face join the protruding portions to form a U shape. Such a U shape improves the mechanical retention of the housing.

Advantageously, the U shapes of the electrically-conducting cover are arranged to be positioned outside the lateral parts of the electrically-conducting body.

A final subject of the invention is a method of assembly of a connector or of an assembly of multiway connections such as previously described, comprising the following steps:

(a) installation or potting of at least one contact in the electrical insulator, (b) installation of the insulator accommodating the contact(s) in the electrically-conducting body, (c) installation of the sub-assembly formed by the body and the insulator accommodating the contact(s) in the housing, (d) installation from below of the conducting cover, until its insertion into the conducting body is obtained, with accommodation of the protruding portions in the cavity of the housing in order to form two blocking points, in the two sense of the longitudinal direction (X), of the electrically-conducting cover in the housing.

Advantageously, the step (d) is carried out with:

the cover abutting against the body, and/or retention of the cover inside of the housing.

Other advantages and features of the invention will become more clearly apparent upon reading the detailed description of exemplary embodiments of the invention presented by way of non-limiting illustration and with reference to the following figures.

DETAILED DESCRIPTION

FIGS. 1 to 5B relating to an L-shaped connector according to the prior art have been described in the introduction. They will not therefore be commented on hereinafter.

For the sake of clarity, the same structural element of a connector according to the prior art and according to the invention is denoted with the same numerical reference.

It is noted here that, in the assembly of the present application, the terms "lower", "upper", "above", "below", "interior", "exterior", "internal", "external" are to be understood by reference to a connector according to the invention in a substantially horizontal configuration.

Similarly, the terms "front" and "rear" are to be understood with reference to the connection face of the connector, situated at the front of the latter.

Figure 1:
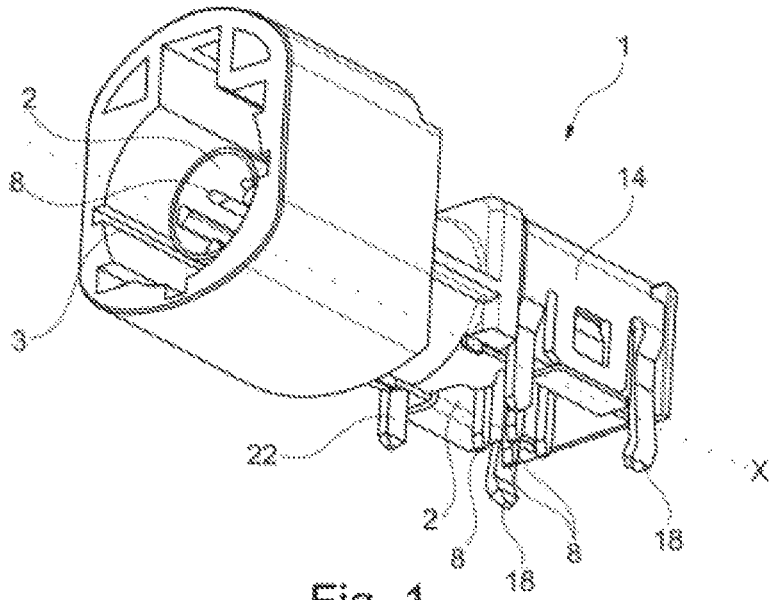
Fig. 1 PRIOR ART
FIG. 1 is a perspective view from the front of an L-shaped connector for connection to a printed circuit board according to the prior art.
Figure 2:
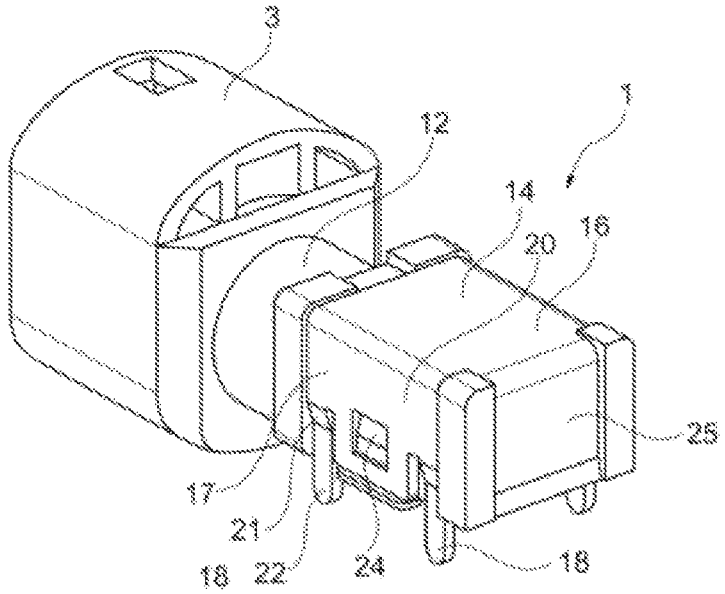
Fig. 2 PRIOR ART
FIG. 2 is a perspective view from the front of the L-shaped connector according to FIG. 1.
Figure 3:
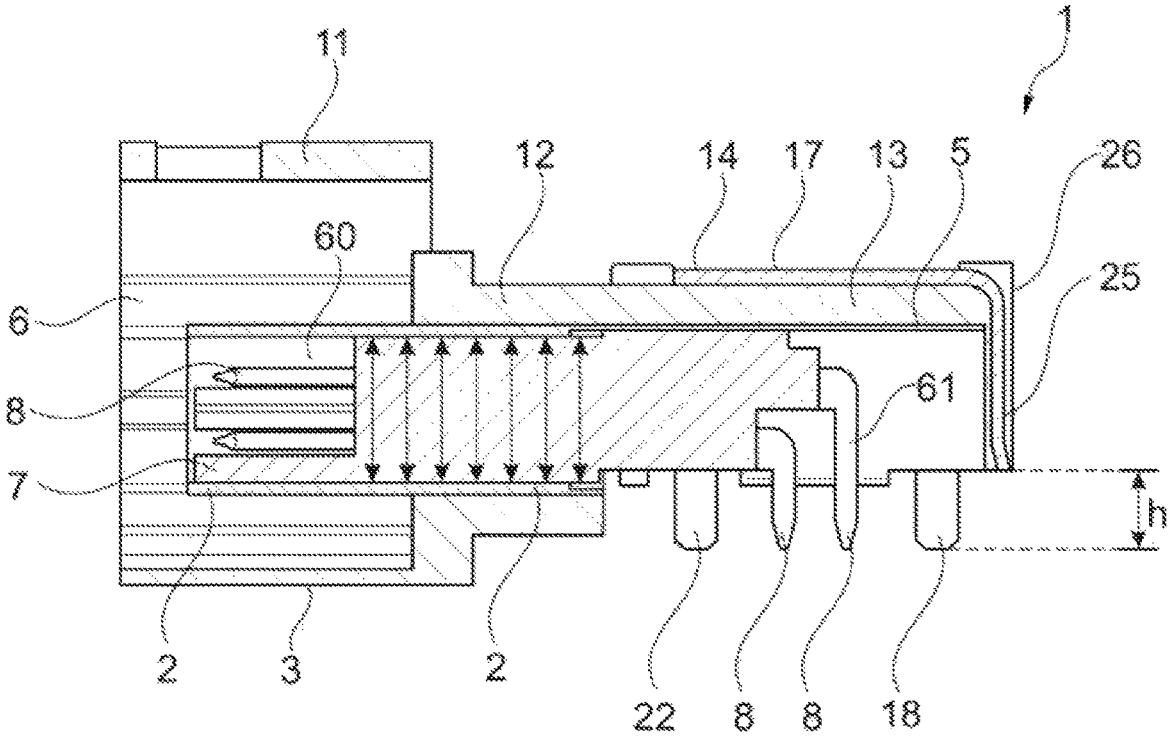
Fig. 3 PRIOR ART
FIG. 3 is a longitudinal cross-sectional view of the L-shaped connector according to FIGS. 1 and 2.
Figure 4:
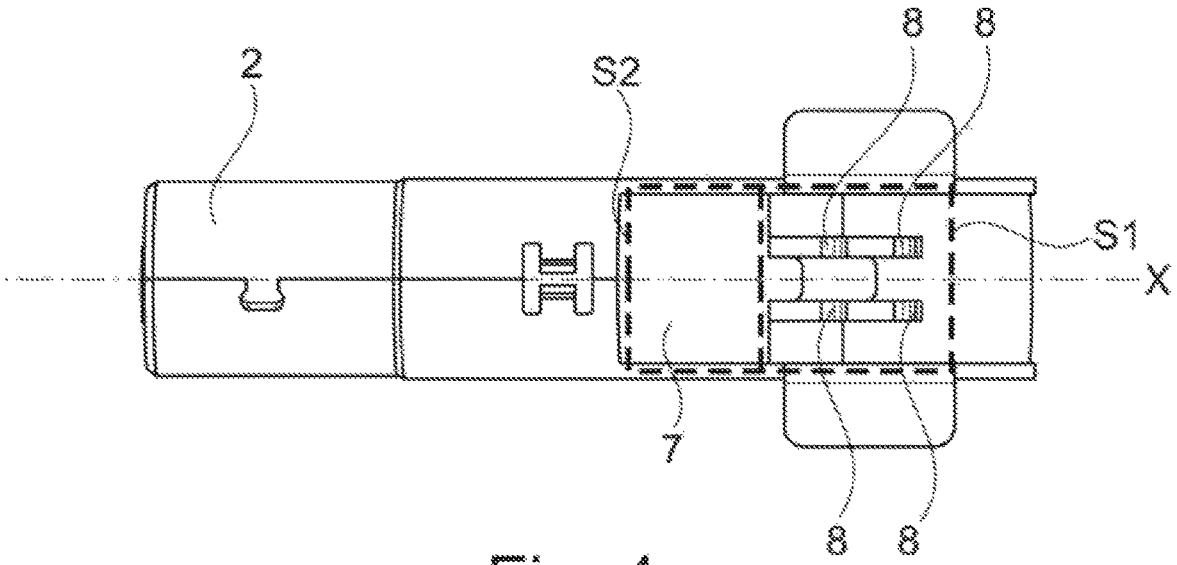
Fig. 4 PRIOR ART
FIG. 4 is a perspective view from below of a sub-assembly comprising the conducting body, the insulator and the central contacts of an L-shaped connector according to FIGS. 1 to 3.
Figure 5A:
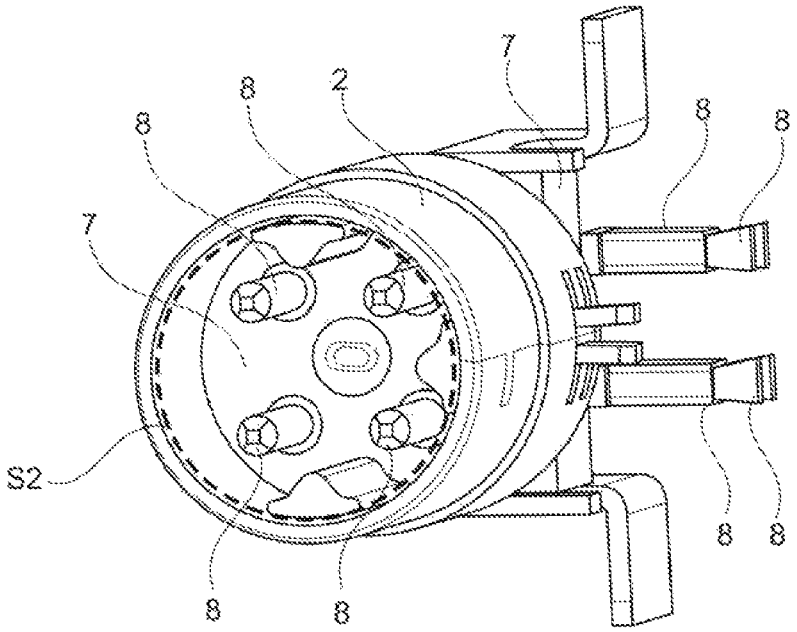
Fig. 5A PRIOR ART
FIG. 5A is a front face view of a sub-assembly comprising the conducting body, the insulator and the central contacts of an L-shaped connector according to FIGS. 1 to 3.
Figure 5B:
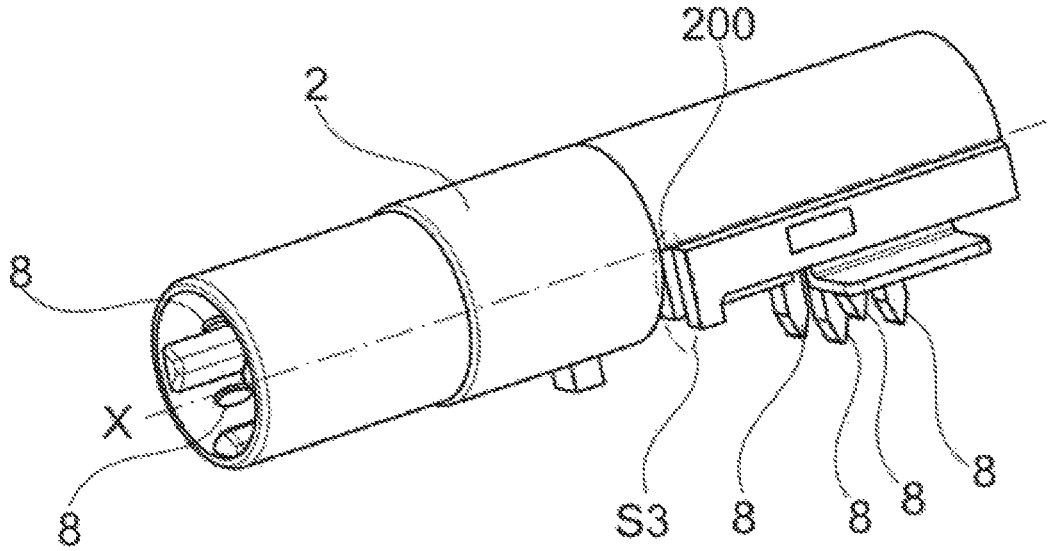
Fig. 5B PRIOR ART
FIG. 5B is a perspective view of a sub-assembly comprising the conducting body, the insulator and the central contacts of an L-shaped connector according to FIGS. 1 to 3.
Figure 6:
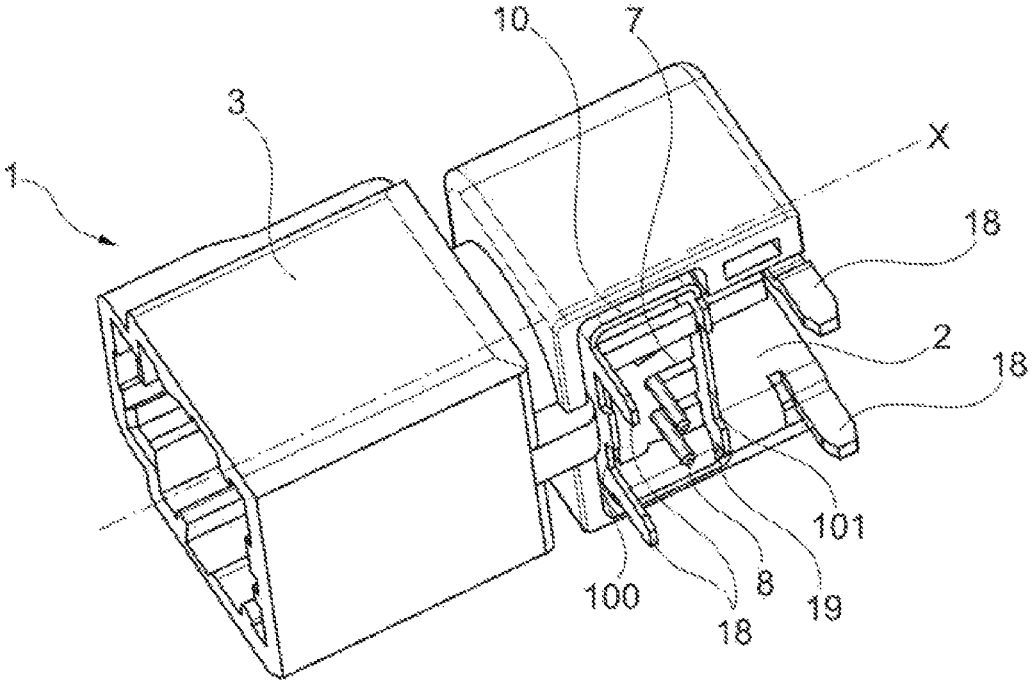
FIG. 6 is a perspective view of one example of an L-shaped connector with a conducting cover as a single piece, for connection to a printed circuit board according to the invention.
Figure 7:
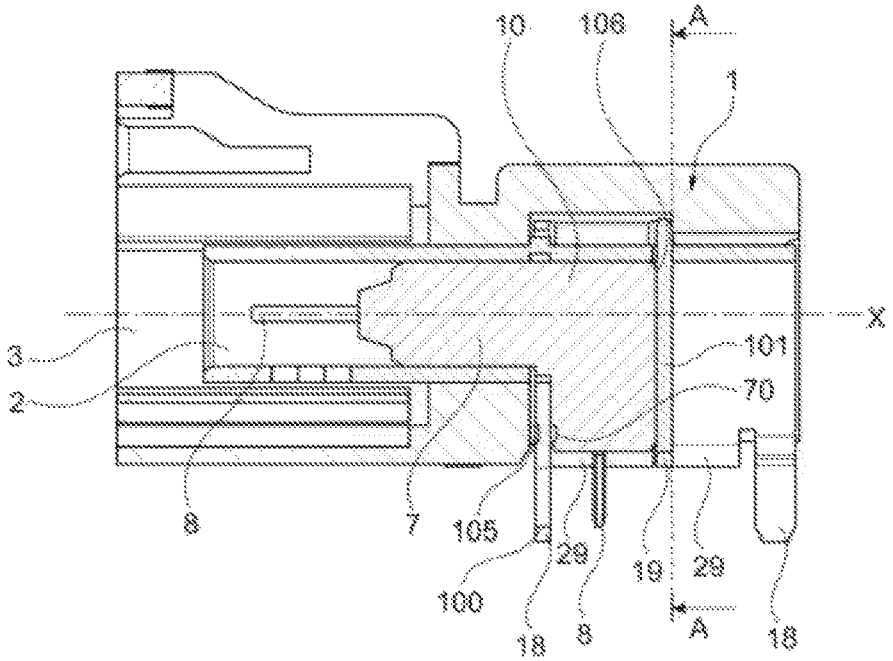
FIG. 7 is a longitudinal cross-sectional view of an L-shaped connector according to FIG. 6.

FIGS. 6 and 7 show an L-shaped connector 1 according to the invention extending along a longitudinal axis (X), designed to provide a connection with a printed circuit board (PCB).

The L-shaped connector 1 comprises an electrically-conducting body 2, central contacts 8 accommodated, at least in part, within the body 2 with interposition of an electrical insulator 7.

An electrically-insulating housing 3, defining an accommodation, accommodates all or part of the body 2.

The body 2 advantageously comprises support feet 29 designed to rest against the PCB.

According to the invention, an electrically-conducting cover 10 is provided composed, in the example described, of a single piece, inserted into the electrically-conducting body 2.

This conducting cover 10 is preferably formed by a 'cut-and-roll' technique, in a similar manner to the conducting body 2.

Figure 11:
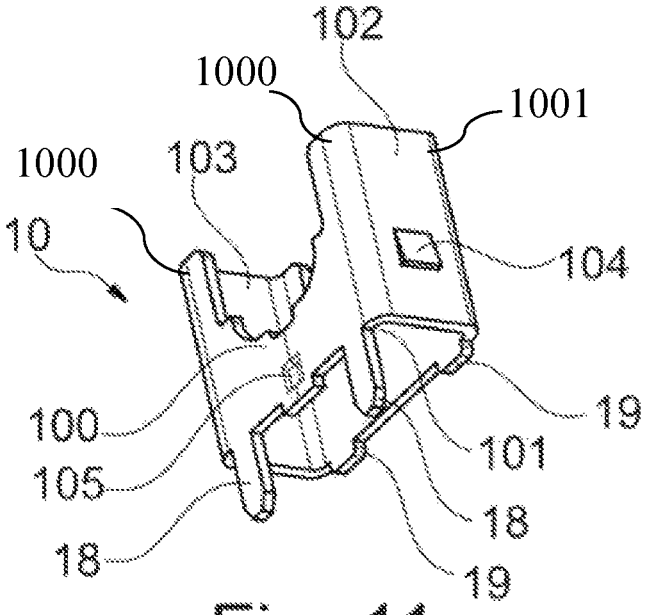
FIG. 11 is a perspective view from below of a conducting cover according to the invention.

As illustrated in FIG. 11, the conducting cover 10 has a generally rectangular shape and thus comprises two parallel sides forming the main faces 100, 101 connected together via lateral faces 102, 103.

The dimensions of the various faces 100 to 103, together with their contours, are defined so that the main faces 100, 101 cover, at least partially, the electrical insulator 7, in the part of its accommodation inside of the conducting body 10 which is lacking a wall. This allows the openings of the body 2 to be blocked and hence the risks of leakages of HF signals to be eliminated.

In addition, the screen against electromagnetic interference (known by the acronym EMI), formed by the conducting cover 10, is advantageously completed by the contact of the tabs 29 of the body 2 onto the PCB.

Furthermore, the conducting cover 10 is positioned as close as possible to the insulator 7 by virtue of the slots 200 and 201 in the body. In other words, the main faces 100 and 101 of the conducting cover 10 can be perfectly inserted into the slots 200, 201 while at the same time covering the front and rear faces of the electrical insulator 7.

This allows a cross-section of insulator to be kept as constant as possible between the connection part with the printed circuit board, on the underside of the L-shaped connector, and the connection part with a complementary connector and hence the uniformity of the propagation of the signal to be improved.

Figure 9:
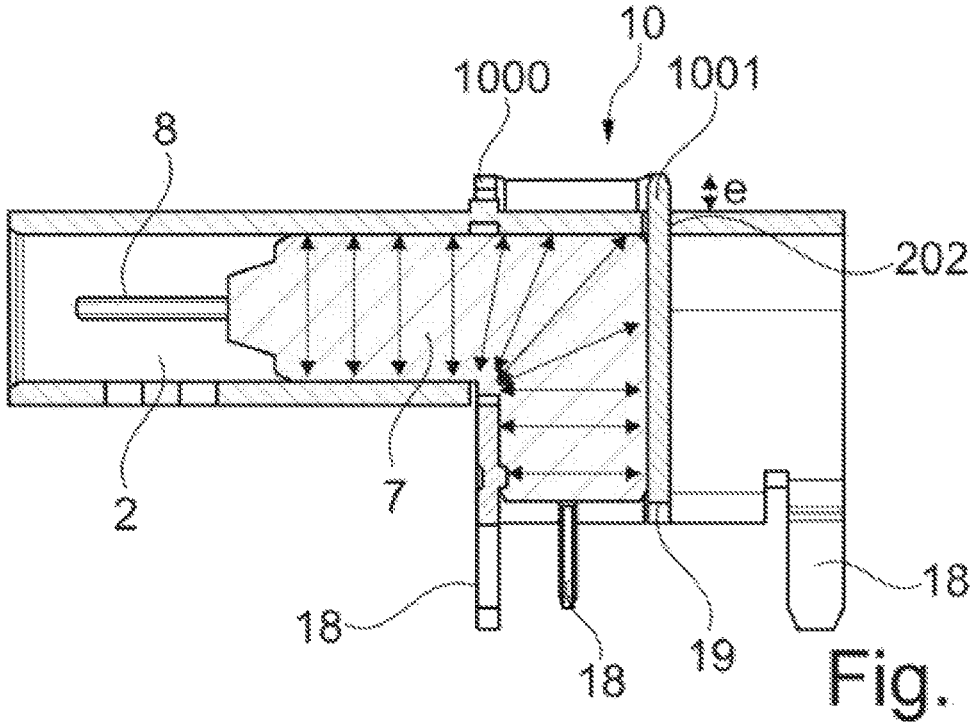
FIG. 9 is a longitudinal cross-sectional view of a sub-assembly according to FIG. 8.
Figure 10:
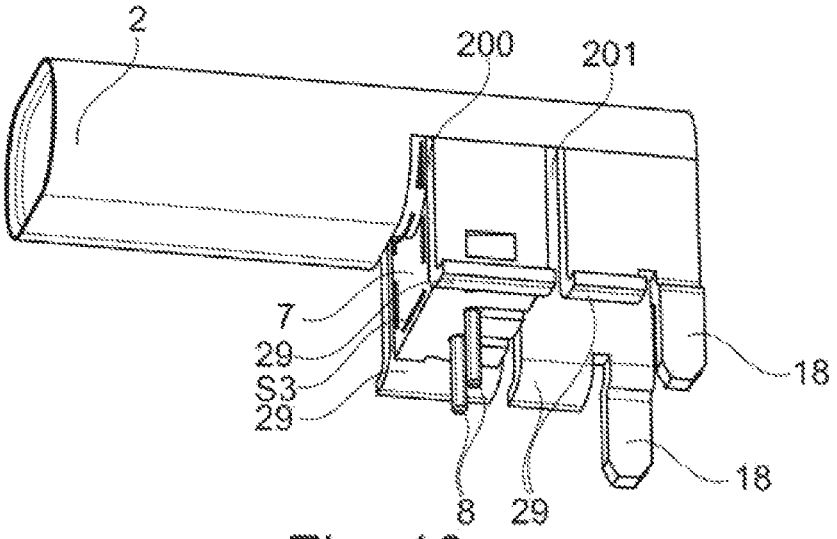
FIG. 10 is a perspective view from below of a sub-assembly according to FIG. 9 without the presence of the conducting cover as a single piece, according to the invention.

This is clearly illustrated in FIG. 9, where it can be seen that the transmission line for an HF signal inside of the connector 1 according to the invention, symbolized by the pathway of the double-arrows, is perfectly guided and contained between the conducting body 2 and the main faces 100, 101 of the conducting cover 10 with similar dimensions.

In other words, the conducting cover 10 forms, with the conducting body 2, a metal envelope over the whole transmission line for the HF signals inside of the L-shaped connector 1. The impedance matching of the ultra-high-frequency line is thus improved.

Also, the spacing between the various faces 100 to 103 of the conducting cover 10 and the location of the slots 200, 201 in the conducting body 2 into which the main faces 100, 101 of the cover 10 are inserted allows a cross-section of insulator to be kept as constant as possible between the connection part with the printed circuit board, on the underside of the L-shaped connector, and the connection part with a complementary connector. Preferably, the main faces 100, 101 of the cover 10 are in contact with interference fit respectively against the front and rear faces of the electrical insulator 7 in order to guarantee the mechanical positioning of the insulator and in order to improve the ultra-high-frequency matching.

Figure 13:
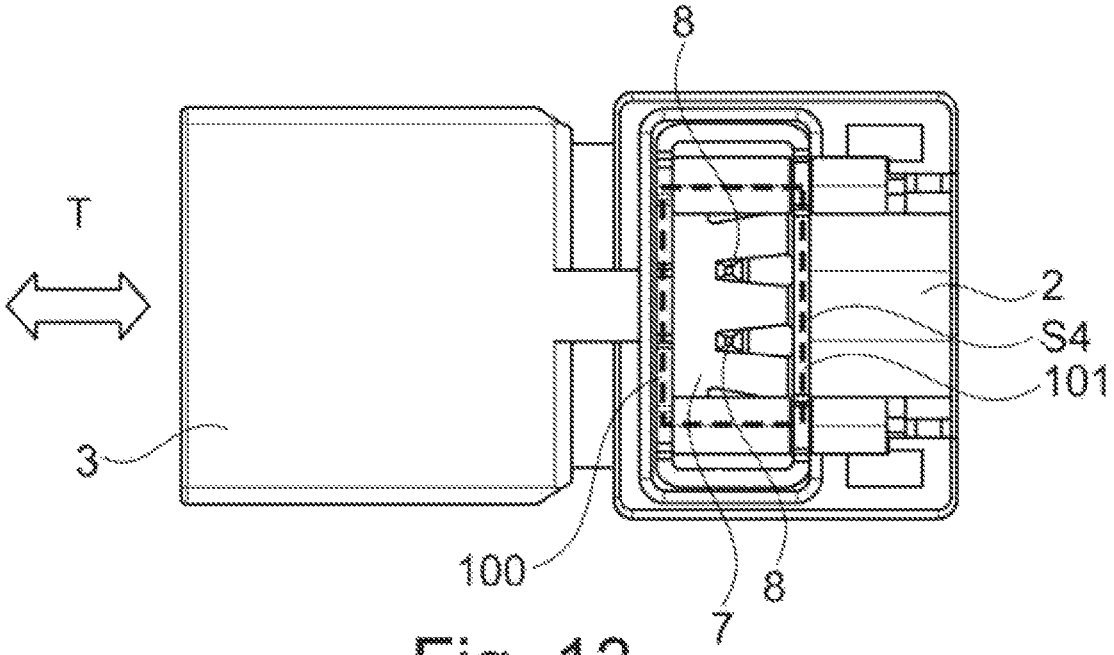
FIG. 13 is a view from below of an L-shaped connector according to FIGS. 6 and 7.

This is symbolized in FIG. 13 by the bold dashed frame bounding a cross-section S4 of insulator 7 within which the HF signals are transmitted, which is constant from the connection part underneath the connector 1 up to its connection front face.

Figure 8:
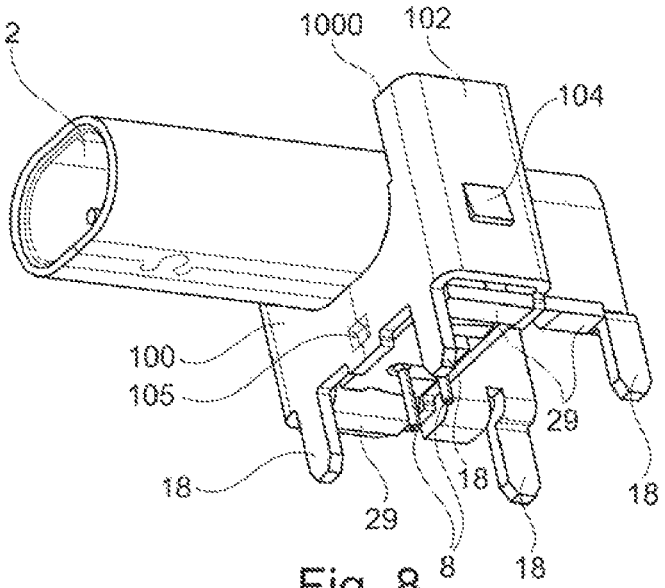
FIG. 8 is a perspective view from below of a sub-assembly comprising the conducting cover according to the invention, the conducting body, the insulator and the central contacts of an L-shaped connector according to FIGS. 6 and 7.

Preferably, as clearly illustrated in FIG. 8, the cover 10 is in physical contact with the body 2 in order to provide a bulk material continuity.

The conducting cover 10 may advantageously comprise one or more retention profiles 104, for example one per lateral face 102, 103, which allows the retention of the cover 10 within the housing 3 (FIG. 8) to be ensured. Thus, in the event of an effort to tear off the housing 3 in a direction orthogonal to the direction X, the latter is strongly retained by retention reliefs 104. More particularly when the connector is fixed to the PCB by means of the fixing lugs 18, the retention reliefs 104 which are held by snap-fastening inside complementary reliefs in the housing 3 make it possible to mechanically retain the latter in the event of a tear-off effort from the PCB, that is to say a tensile force to move the connector away from the PCB.

Furthermore, the conducting cover 10 may advantageously comprise one or more blocking profiles 105, for example one on the main front face 100, in order to block the latter on the cover 10 (FIGS. 7, 8).

Figure 12:
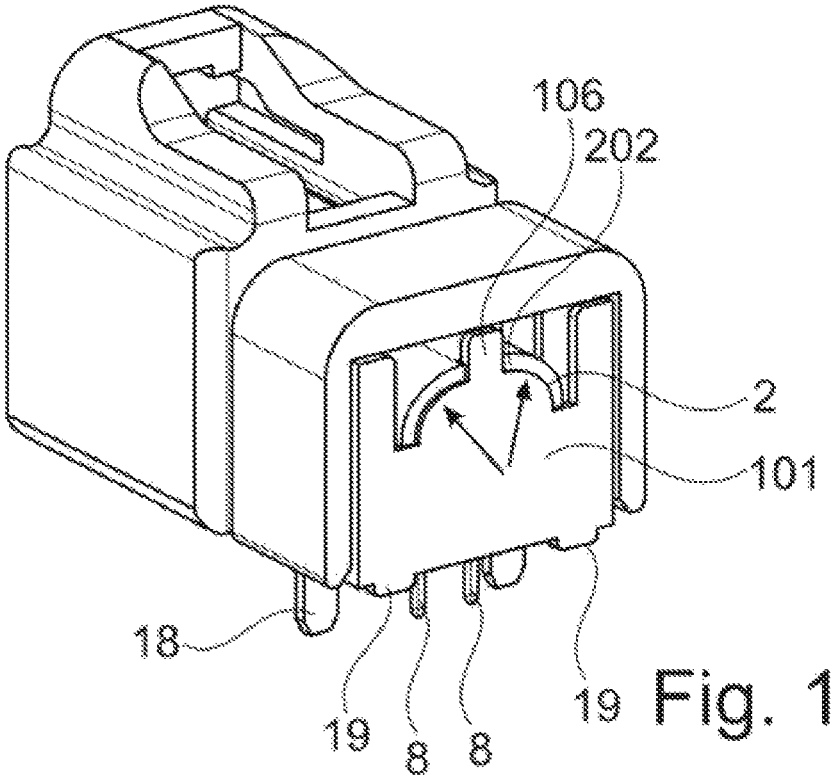
FIG. 12 is a perspective transverse cross-sectional view and along A-A of an L-shaped connector according to FIGS. 6 and 7.

Furthermore, the rear main face 101 of the cover 10 is advantageously equipped with a tab 106 which is inserted into a slot 202 provided for this purpose at the rear of the body 2 (FIG. 12). Thus inserted, this tab 106 prevents the flexing of the rear main face 101, when a user pushes the insulator 7 and the central contacts 8 towards the rear. In other words, this tab 106 allows an additional take up of forces.

Lastly, the conducting cover 10 may be equipped with legs 18 for fixing to a printed circuit board (PCB). As illustrated, fixing legs 18 may be provided which can be directly inserted into the PCB prior to being soldered into it, In the examples illustrated, the long fixing legs 18 are preferably formed on the lower end of the main front face 100 of the cover 10, whereas short legs 19, for the connection of the electrical ground, are formed on the lower end of the rear main face 101 of the cover 10.

The conducting body 2 may also be equipped with fixing legs 18 which participate, with the fixing legs 18 of the cover 10, in the complete fixing of the L-shaped connector 1 onto a PCB.

Figure 14:
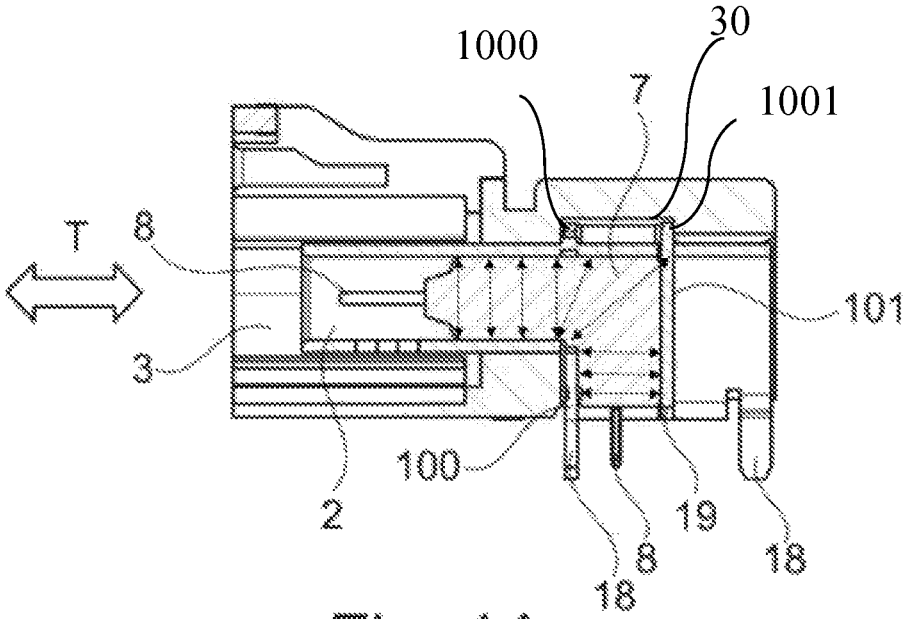
FIG. 14 is a longitudinal cross-sectional view of an L-shaped connector according to FIGS. 6 and 7.

Advantageously, the cover 10 may be dimensioned such that, once installed and preferably held in the housing 3, it has portions 1000, 1001 which protrude above the body 2 being arranged into a cavity 30 of the housing 3 (FIGS. 8, 9). This protruding arrangement according to a height e of these portions 1000, 1001 allows the housing 3 to be mechanically held on the body 2. Thus, when a traction force is applied to the housing 3, as symbolized by the double-arrow T in FIGS. 13 and 14, that is to say according to a direction parallel to the plane of a PCB on which the connector is fixed, the cover 10 acts as a mechanical end-stop of the housing 3. In other words, these portions 1000, 1001 form at least two, preferably four blocking points of the electrically-conductive cover 10 in the housing 3.

As can be seen in all of FIGS. 6 to 14, the conducting body 2 and the housing 3 are dimensioned so as to create a volume of material at the rear of the electrical insulator 3 which allows the centre of gravity of the connector to be well positioned, in order for it to have a better stability when it is resting against a printed circuit PCB. Furthermore, the elongated body 2 at the rear of the insulator 7 allows it to be given rear legs 18 for fixing to the PCB by soldering that are far from the legs 18 at the front, which also contributes to a better fixing.

The various steps for assembly of an L-shaped connector 1 according to the invention are now described with reference to FIGS. 15A to 15E. In these various figures, the direction of installation of one component in the other is indicated by an arrow.

Figure 15:
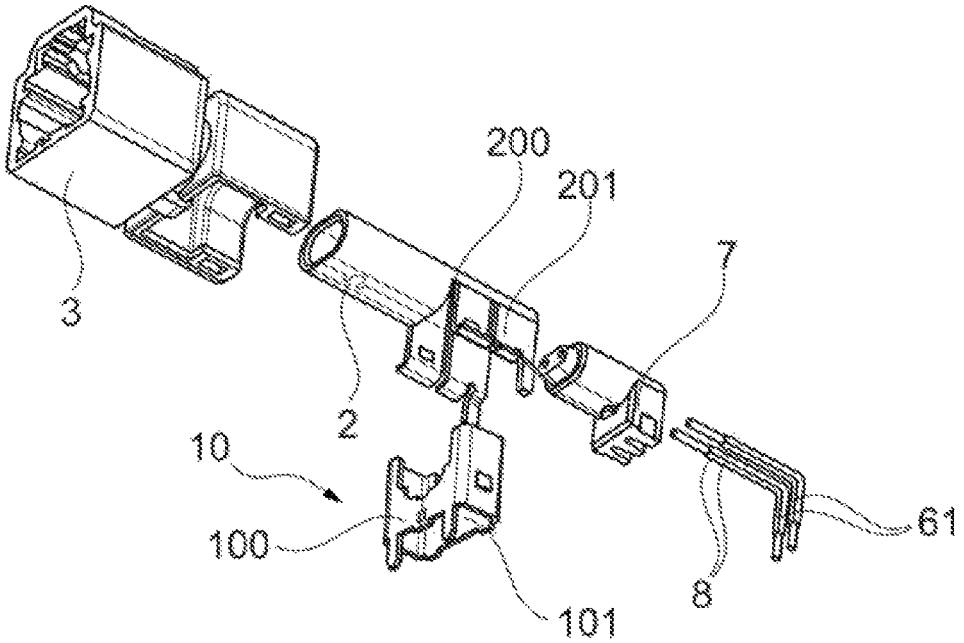
FIG. 15 is an exploded view of an L-shaped connector according to the invention, with a conducting cover as a single piece.
Figure 15A:
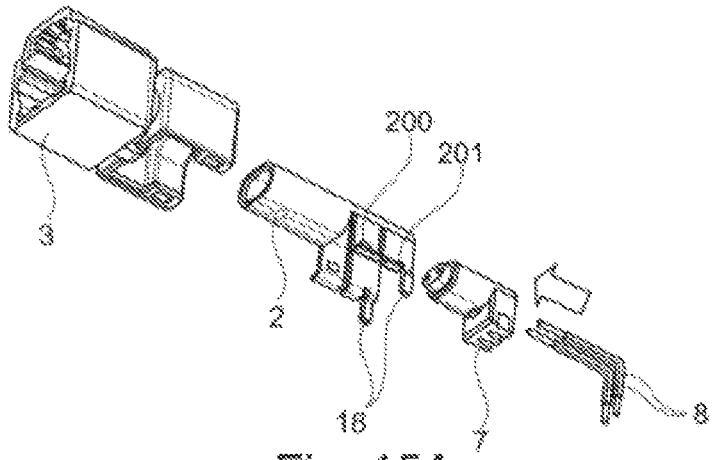
FIG. 15A is a perspective view illustrating a step for assembly of an L-shaped connector according to the invention, with a conducting cover in a single piece.
Figure 15B:
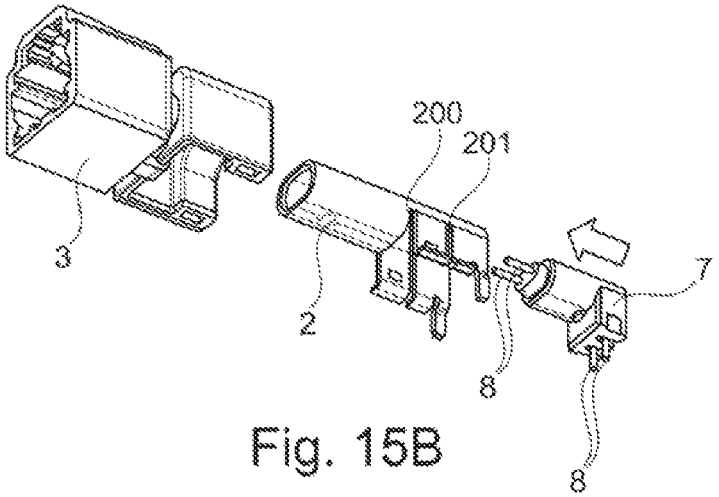
FIG. 15B is a perspective view illustrating a step for assembly of an L-shaped connector according to the invention, with a conducting cover in a single piece.
Figure 15C:
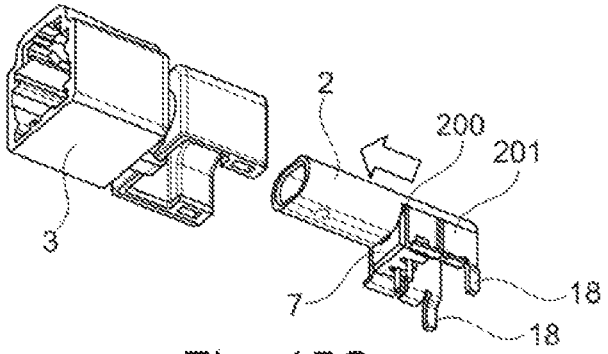
FIG. 15C is a perspective view illustrating a step for assembly of an L-shaped connector according to the invention, with a conducting cover in a single piece.

Initially, all of the components essential to the assembly are provided, namely the conducting body 2, the housing 3, the electrical insulator 7, the central contacts 8, together with the conducting cover 10 according to the invention (FIG. 15A).

Step a/: The installation of the central contacts 8 is carried out by insertion into the insulator 7 (FIG. 15A). Instead and in place of this, a potting of the central contacts 8 may be envisaged by an electrically-insulating material ultimately forming the insulator 7 around the central contacts 8.

Step b/: The installation of the first sub-assembly thus formed of the insulator 7 accommodating the central contacts 8 in the conducting body 2 (FIG. 15B) is carried out.

Step c/: The installation of the second sub-assembly thus formed of the insulator 7 with the conducting body 2 and the central contacts 8 in the housing 3 (FIG. 15C) is carried out.

Figure 15D:
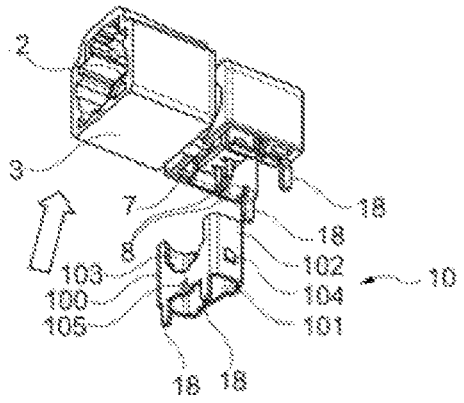
FIG. 15D is a perspective view illustrating a step for assembly of an L-shaped connector according to the invention, with a conducting cover in a single piece.

Step d/: Then, the installation from below of the conducting cover 10 is carried out, in such a manner that its main faces 100, 101 are inserted into the corresponding slots 200, 201 of the conducting cover 2 (FIG. 15D).

In other words, the main faces 100, 101 are slid into the slots 200, 201 from the underside of the body 2 and preferably until they abut against the body 2.

This step d/ is preferably carried out until the cover 10 abuts against the body 2.

Preferably also, the installation of the cover 10 is carried out with locking of each protruding profile 105 into the corresponding groove 70 of the insulator 7 and until the retention by capture or clip-on of the cover 10 within the housing 3 by means of each protruding profile 104 which is captured or clipped inside of the complementary profile formed for this purpose inside of the housing 3.

This d/ is carried out with accommodation of the portions 1000, 1001 in the cavity 30 of the housing 3 such that the cover 10 forms a mechanical abutment to the housing 30 with the portions 1000, 1001 which act as blocking points so as to form two blocking points in the two sense of the longitudinal direction (X) of the conductive cover 10 in the housing 3.

Figure 15E:
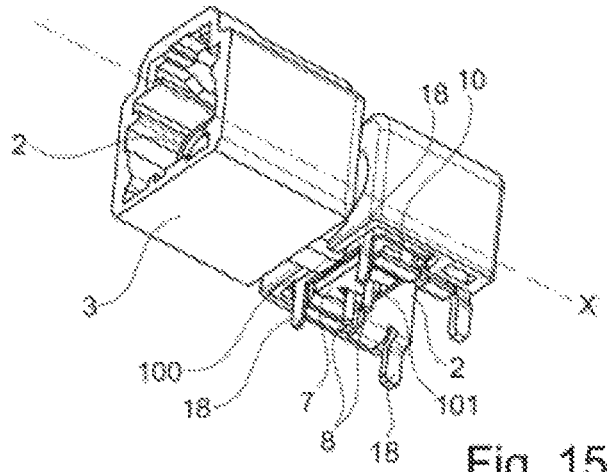
FIG. 15E is a perspective view illustrating a step for assembly of an L-shaped connector according to the invention, with a conducting cover in a single piece.
Figure 16:
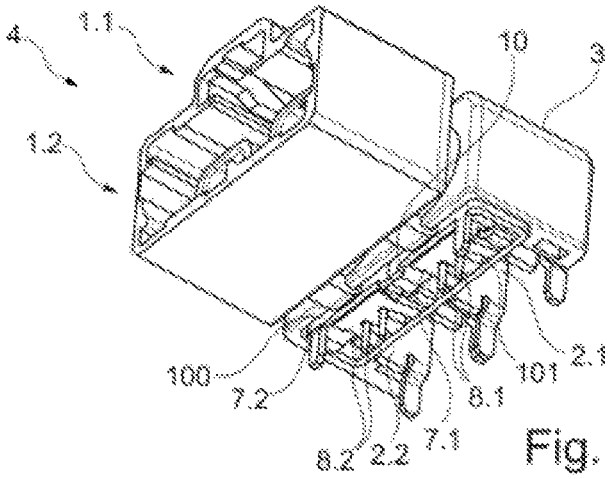
FIG. 16 is a perspective view from the front of an assembly of multiway connections with two L-shaped connectors according to the invention, arranged side-by-side.
Figure 17:
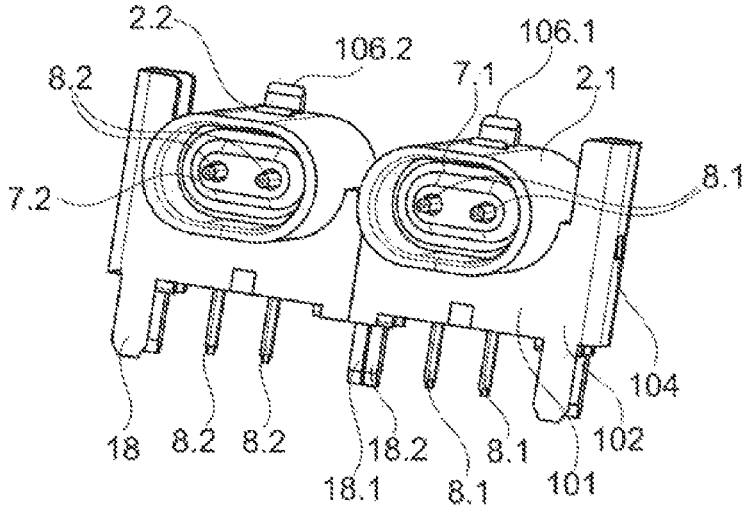
FIG. 17 is a perspective view from the front of a sub-assembly comprising the conducting cover according to the invention, the conducting body, the insulator and the central contacts of a connection assembly according to FIG. 16.
Figure 18:
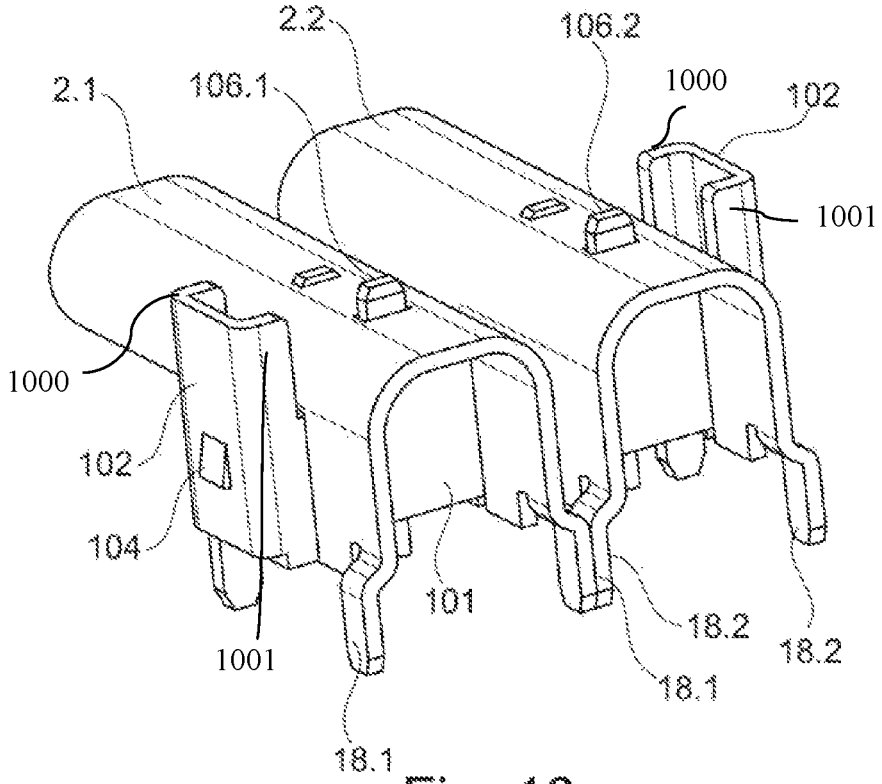
FIG. 18 is a perspective view from the rear of a sub-assembly comprising the conducting cover according to the invention, the conducting body, the insulator and the central contacts of a connection assembly according to FIG. 16.
Figure 19:
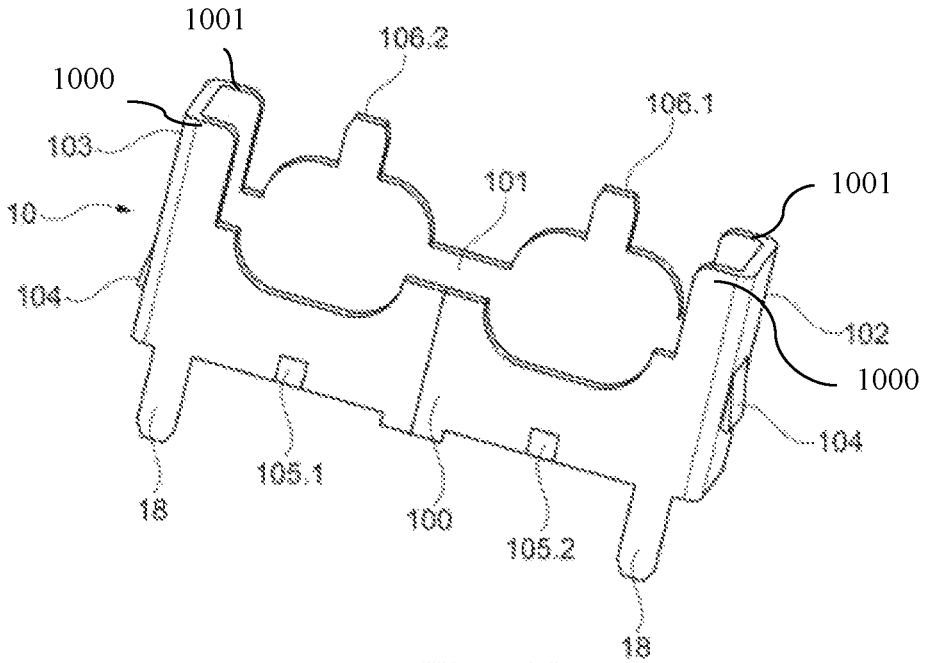
FIG. 19 is a perspective view from below of a conducting cover according to the invention implemented in the connection assembly according to FIG. 16.

Step e/: Once the installation of the conducting cover 10, and preferably its retention in the housing 3, has been carried out, the L-shaped connector according to the invention is ready to be used (FIG. 15E).

A connection assembly 4 will now be described with reference to FIGS. 16 to 19 that comprises two L-shaped connectors 1.1, 1.2 according to the invention, arranged side-by-side, generally referred to as a duplex arrangement.

In this illustrated example, the assembly 4 comprises a single housing 3 composed of a single piece, forming a housing common to the two connectors 1.1, 1.2 and in which two feedthrough accommodations are formed, each of these feedthrough accommodations receiving one of the two connectors 1.1, 1.2.

Also, the connection assembly 4 comprises a single conducting cover 10 with fixing legs 18, made from a single piece, which is common to the two connectors 1.1, 1.2.

Each of the connectors 1.1, 1.2 comprises a conducting body 2.1, 2.2 with fixing legs 18.1, 18.2, an insulator 7.1, 7.2 and central contacts 8.1, 8.2 specific to it and similar to those already described with reference to FIGS. 6 to 15E.

Also, the common cover 10 comprises blocking profiles for the insulator 105.1, 105.2, together with support tabs 106.1, 106.2 which are separate ones for each connector 1.1, 1.2 and similar to those already described with reference to FIGS. 6 to 15E.

On the other hand, the common cover 10 comprises blocking portions 1000, 1001 in the housing 3 and profiles 104 for retention to the housing 3 which are common to the two connectors 1.1, 1.2 and similar to those already described with reference to FIGS. 6 to 15E.

In all of the FIGS. 6 to 15E, the conducting cover 10 according to the invention is formed as a single piece.

Figure 20:
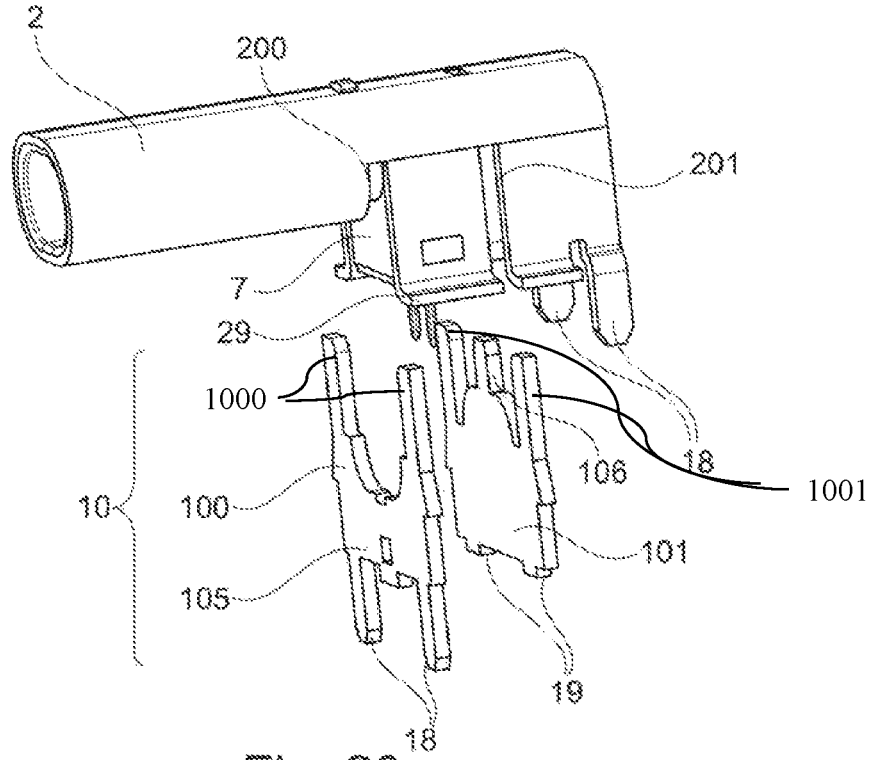
FIG. 20 is an exploded view of one example of a sub-assembly for an L-shaped connector, comprising a conducting cover in two pieces according to the invention, a conducting body and an insulator.
Figure 21:
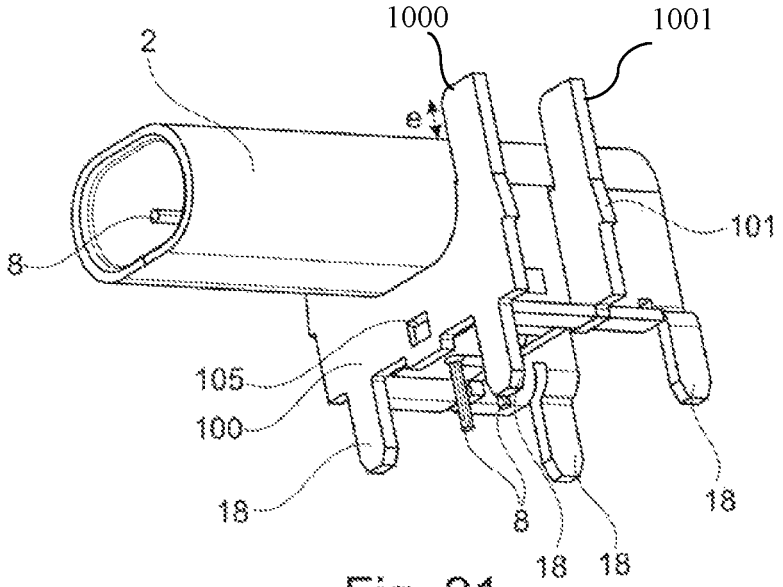
FIG. 21 is a perspective view of the sub-assembly in FIG. 20 in an assembled configuration.
Figure 22:
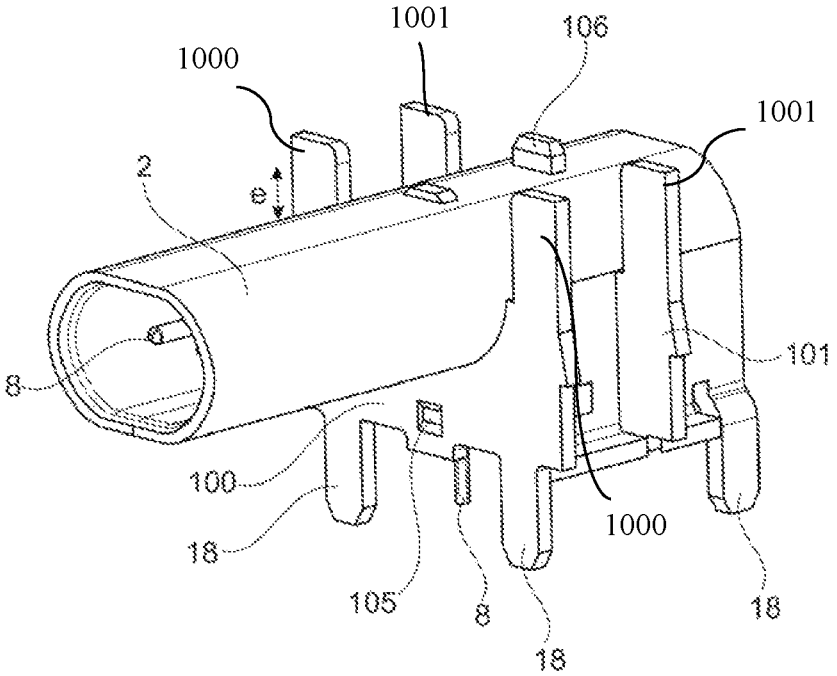
FIG. 22 is another perspective view of the sub-assembly in FIG. 20 in an assembled configuration.

FIGS. 20 to 22 show another embodiment according to which the conducting cover 10 is formed as two separate pieces 100, 101. As shown in these figures, these two pieces 100, 101 may take exactly the same form as the two front and rear main faces 100, 101 of the cover 10 when it is formed with a single piece, in other words with lateral faces 102, 103 that join to the two main faces.

Thus, in the embodiment in FIGS. 20 to 22, the two plane pieces 100, 101 can each be respectively inserted into the slot 200, 201 of a conducting body 2.

Other variants and advantages of the invention may be implemented without however straying from the scope of the invention.

For example, although in all of the examples illustrated, the connectors equipped with a conducting cover according to the invention are L-shaped connectors, the invention is also applicable to all straight connectors that can be equipped with a conducting cover.

Similarly, the conducting cover 10 may be formed as a single or several pieces according to various shapes. Thus, aside from an embodiment as a single piece with front and rear main faces 100, 101 (FIGS. 6 to 15E), and an embodiment with two plane pieces 100, 101 (FIGS. 20, 22), it may be envisaged to form the conducting cover 10 according to the invention in two generally L-shaped pieces, when viewed from the side, for example an L-shaped piece which would be composed of the main face 100 and the lateral face 102, whereas the other L-shaped piece would be composed of the main face 101 and the lateral face 103.

The invention is not limited to the examples which have just been described; features of the examples illustrated may notably be combined together within variants not illustrated.

The invention claimed is:

1. A connector, designed for a connection to a printed circuit board, the connector extending along a longitudinal axis (X) and comprising:

an electrically-conducting body, at least one contact accommodated, at least in part, within the body with interposition of an electrical insulator between them, a housing defining an accommodation configured for receiving all or part of the body, the housing comprising a cavity, an electrically-conducting cover composed of at least one piece comprising a plurality of main faces, wherein the cover is inserted in the electrically-conducting body in such a manner that at least one of the main faces covers a front of the electrical insulator in a rear part of an accommodation for receiving the electrical insulator inside of the electrically-conducting body which is lacking a wall, wherein the electrically-conducting cover comprises protruding portions which protrude above the body and are arranged into the cavity of the housing so as to form two blocking points for blocking in two directions along the longitudinal axis (X), the electrically-conducting cover in the housing.

2. The connector according to claim 1, wherein the conducting body is formed with at least one slot in the front of the electrical insulator, said at least one of the main faces of the cover covering said slot.

3. The connector according to claim 1, wherein another of the main faces of the cover covers a rear of the electrical insulator.

4. The connector according to claim 3, wherein the conducting body is formed with at least one slot, at the rear of the electrical insulator, said another main face of the cover covering said slot.

5. The connector according to claim 1, wherein said at least one of the main faces and/or another of the main faces of the cover has an exterior shape designed to fit that of the body.

6. The connector according to claim 1, wherein the cover is composed of a single piece of generally rectangular shape, and wherein the main faces of said cover comprise two parallel main faces that are connected via two lateral faces.

7. The connector according to claim 6, wherein the cover is formed according to a cut-and-roll technique.

8. The connector according to claim 6, wherein the single piece is shaped so that each lateral face joins the protruding portions to form a U shape.

9. The connector according to claim 1, wherein the connector is L-shaped with the at least one contact which extend along the longitudinal axis (X) and which comprise at least one inclined portion, being perpendicular, with respect to a plane (P) defined by a printed circuit board to which the connector is designed to be connected.

10. The connector according to claim 1, wherein the electrical insulator forms a L-shape, the main faces of the cover being perpendicular both to a plane (P), defined by a printed circuit board to which the connector is designed to be connected, and to the direction of connection with a complementary connector along the axis X, while covering the electrical insulator on either side of an elbow.

11. The connector according to claim 1, wherein the cover is inserted in the body with physical contact between them.

12. The connector according to claim 1, wherein the cover comprises at least one blocking profile designed to capture the insulator, so as to block the latter.

13. The connector according to claim 1, wherein the cover connects the main faces, comprising at least one retaining profile cooperating with a complementary retaining profile in the housing, so as to retain the cover in the housing.

14. The connector according to claim 1, wherein the main faces comprise a rear main face including at least one support tab cooperating with a notch formed in the body, so as to prevent the flexing of said rear face when the insulator and/or the at least one contacts is pushed towards the rear of the connector.

15. The connector according to claim 1, the cover comprising at least one leg designed to allow the fixing of the connector onto a printed circuit board.

16. An assembly of multiway connections, comprising at least two connectors, each comprising an electrically-conducting body according to claim 1, arranged side-by-side in a housing, and a cover formed as at least one piece comprising a plurality of main faces, wherein the cover is inserted into the electrically-conducting bodies, such that at least two of its the main faces cover, at least partially, electrical insulators, in parts of their accommodations inside of the respective electrically-conducting bodies which are lacking a wall.

17. The assembly according to claim 16, wherein the cover is composed of a single piece of generally rectangular shape, and wherein the main faces of said cover comprise two parallel main faces that are connected via two lateral faces.

18. A method of assembly of a connector according to claim 1 or an assembly of multiway connections according to claim 16, comprising the following steps:

(a) installation or potting of at least one contact in the electrical insulator, (b) installation of the insulator accommodating the contacts in the electrically-conducting body, (c) installation of a sub-assembly formed by the body and the insulator accommodating the contact in the housing, (d) installation from below the conducting cover, until its insertion into the conducting body is obtained, with accommodation of the protruding portions in the cavity of the housing so as to form two blocking points, for blocking in two directions along the longitudinal axis (X) the electrically-conducting cover in the housing.

* * * * *